US006739026B2

(12) United States Patent
Harajiri

(10) Patent No.: US 6,739,026 B2
(45) Date of Patent: May 25, 2004

(54) METHOD OF MANUFACTURING A HEAD CHIP

(75) Inventor: Toshihiko Harajiri, Chiba (JP)

(73) Assignee: Seiko Instruments Inc., Chiba (JP)

( * ) Notice: Subject to any disclaimer, the term of this patent is extended or adjusted under 35 U.S.C. 154(b) by 305 days.

(21) Appl. No.: 09/864,938

(22) Filed: May 24, 2001

(65) Prior Publication Data

US 2002/0004295 A1 Jan. 10, 2002

(30) Foreign Application Priority Data

May 26, 2000 (JP) ..... 2000-155782

(51) Int. Cl.[7] ..... H04R 17/00

(52) U.S. Cl. ..... 29/25.35; 29/890.1; 310/328; 310/330; 347/69; 347/72; 427/78; 427/123; 427/124; 427/125; 427/422; 427/427

(58) Field of Search ..... 29/25.35, 890.1; 427/78, 123, 124, 125, 422, 427; 310/328, 330–333; 347/69, 72

(56) References Cited

U.S. PATENT DOCUMENTS

| | | | | |
|---|---|---|---|---|
| 5,485,663 A | * | 1/1996 | Ochiai et al. | 29/25.35 |
| 5,983,471 A | * | 11/1999 | Osawa | 29/25.35 |
| 6,431,690 B1 | * | 8/2002 | Shinkai et al. | 347/68 |
| 6,560,833 B2 | * | 5/2003 | Nishi et al. | 29/25.35 |
| 6,568,797 B2 | * | 5/2003 | Yamauchi et al. | 347/70 |

FOREIGN PATENT DOCUMENTS

| | | | | |
|---|---|---|---|---|
| JP | 05050607 A | * | 3/1993 | B41J/2/16 |
| JP | 08244233 A | * | 9/1996 | B41J/2/135 |
| JP | 08281957 | | 10/1996 | |
| JP | 09094967 | | 4/1997 | |
| JP | 10157144 | | 6/1998 | |
| JP | 10244677 | | 9/1998 | |
| JP | 11010872 | | 1/1999 | |

OTHER PUBLICATIONS

"The flow structure inside a microfabricated inkjet printhead"; Carl D. Meinhart and Hongsheng Zhang; Journal of Microelectromechanical Systems, vol, 9; Mar. 2000; pp. 67–75.*

* cited by examiner

*Primary Examiner*—A. Dexter Tugbang
*Assistant Examiner*—Paul D Kim
(74) *Attorney, Agent, or Firm*—Adams & Wilks

(57) ABSTRACT

A head chip is manufactured by disposing partition walls made of piezoelectric ceramic between a pair of opposing substrates made of a dielectric material so that the partition walls are spaced apart at a preselected interval to form channels. Inorganic conductive films are formed on a surface of one of the substrates. At least one metal film is formed on a portion of each of the inorganic conductive films. An electrode is formed on a side surface of each of the channels. Each of the electrodes is electrically connected to a respective one of the metal films via a respective one of the inorganic conductive films.

24 Claims, 14 Drawing Sheets

PRIOR ART

PRIOR ART

METHOD OF MANUFACTURING A HEAD CHIP

BACKGROUND OF THE INVENTION

1. Field of the Invention

The present invention relates to a method for manufacturing a head chip which is mounted on an ink-jet type recording apparatus applicable to, for example, a printer and a facsimile.

2. Description of the Related Art

Conventionally, an ink-jet type recording apparatus is known in the technical field, in which a recording head for jetting ink droplets from a plurality of nozzles is employed to record characters and/or images on a recording medium. In such an ink-jet type recording apparatus, the recording head positioned opposite to the recording medium is provided on a head holder, and this head holder is mounted on a carriage so as to be scanned along a direction perpendicular to a transport direction of the recording medium.

In FIG. 12, there is shown an exploded/perspective view of one example of such a recording head. FIGS. 13A and 13B are sectional view of a major portion of this recording head. FIG. 13A is a sectional view of the recording head taken along the longitudinal direction of side walls. FIG. 13B is a sectional view of the recording head taken along the thickness direction of side walls. A plurality of grooves 102 are arranged in a piezoelectric ceramic plate 101 in a parallel manner. The respective grooves 102 are separated from each other by side walls 103. One edge portion of each of the grooves 102 in the longitudinal direction is elongated up to one edge surface of the piezoelectric ceramic plate 101, whereas the other edge portion is not elongated up to the other edge surface of this piezoelectric ceramic plate, and a depth thereof gradually becomes shallow. Also, an electrode 105 used to apply a driving electric field is formed on surfaces of both the side walls 103 on the opening side within each of the grooves 102 along the longitudinal direction.

A cover plate 107 is jointed via an adhesive agent 109 to the grooves 102 of the piezoelectric ceramic plate 101 on the opening side. This cover plate 107 has an ink chamber 111 that constitutes a concave portion which is communicated to the shallow other edge portion of each of the grooves 102 and an ink supply port 112 that is penetrated through a bottom portion of this ink chamber 111 along a direction opposite to the direction of the grooves 102.

A nozzle plate 115 is jointed on an edge surface of a joint member made by the piezoelectric ceramic plate 101 and the cover plate 107, at which the grooves 102 are opened. Nozzle openings 117 are formed in the nozzle plate 115 at such positions located opposite to the respective grooves 102.

It should be noted that a wiring board 120 is fixed on such a surface of the piezoelectric ceramic plate 101, which is located opposite to the nozzle plate 115 and also opposite to the cover plate 107. A wiring line 122 which is electrically connected to each of the electrodes 105 by employing a bonding wire 121 or the like is formed on the wiring board 120. A driver voltage may be applied via this wiring line 122 to the electrode 105.

In the recording head constituted in this manner, when ink is filled from the ink supply port 112 into the respective grooves 102 and a predetermined driving electric field is applied via the electrode 105 to the side walls 103 on both sides of a predetermined groove 102, the side walls 103 are deformed, so that a capacity formed within this predetermined groove 102 is change. As a result, the ink filled inside the grooves 102 may be jetted from the nozzle opening 117.

For example, as shown in FIG. 14, in the case where ink is jetted from a nozzle opening 117 corresponding to a groove 102*a*, a positive driving voltage is applied to both electrodes 105*a* and 105*b* provided in the groove 102*a*, and also electrodes 105*c* and 105*d* located opposite to these electrodes 105*a* and 105*b* are grounded. As a consequence, a driving electric field directed to the groove 102*a* is effected to the side walls 103*a* and 103*b*. When this driving electric field is positioned perpendicular to the polarization direction of the piezoelectric ceramic plate 101, both the side walls 103*a* and 103*b* are deformed along the direction of the groove 102*a* due to the piezoelectric thickness slip effect, so that the capacity defined inside the groove 102*a* is reduced to there by increase pressure. Thus, the ink may be jetted from the nozzle opening 117.

However, since such a head chip employs a large amount of high-cost ceramic, there is a problem in that the manufacturing cost of the head chip is high.

To solve such a problem, Japanese Patent Examined Publication No. Hei 6-6375 has proposed such a head chip which is manufactured by the plate-shaped board made of glass, piezoelectric ceramic plate made by arranging the pressure chambers in the array form on this plate-shaped board, and ink chamber plate made of glass.

In accordance with this head chip, since both the plate-shaped board and the ink chamber plate are made of low-cost glass materials, the head chip can be manufactured economically and the manufacturing time can be shortened.

However, in the foregoing head chip having the glass board, since the electrode for applying the voltage to the piezoelectric ceramic plate has to formed by oblique vapor deposition, the manufacturing cost is increased.

Furthermore, when the wiring lines electrically conducted to this electrode are extracted, these wiring lines are processed by metal plating such as nickel plating or gold plating, and thereafter the metal plated-wiring lines has to be cut one by one by using a laser. Thus, there is another problem in that the process step becomes cumbersome, and the manufacturing cost is increased.

Furthermore, even when the wiring lines are directly formed on the glass board by way of the metal plating, there is another problem in that the fitting characteristic is deteriorated, and thus, the formed wiring lines may readily peel off from the glass board.

SUMMARY OF THE INVENTION

The present invention has been made to solve the foregoing problems in the conventional art, and it is an object of the present invention to provide a method of manufacturing a head chip economically and in a simplified manner.

In order to solve the above problems, according to a first aspect of the present invention, there is provided a method of manufacturing a head chip, in which partition walls made of piezoelectric ceramic are arranged in a predetermined interval between a first upper board and a second lower board, which are made of a dielectric material; chambers are defined among the respective partition walls; and a wiring line is provided on a surface of any one of the first board and the second board, and is electrically conducted to an electrode formed on a side surface of the partition wall, and also is elongated up to an outer side of an edge portion of the partition wall along a longitudinal direction; the manufacturing method characterized by comprising:

a step in which the electrode and a metal film which constitutes a portion of the wiring line are formed by way of selective electroless plating, and these electrode and wiring line are electrically conducted to each other.

According to a second aspect of the present invention, in the first aspect of the present invention, there is provided a manufacturing method of a head chip characterized in that:

at least in a region corresponding to the chamber, the inorganic conductive film is formed on a portion located opposite to both edge portions of the partition wall in a width direction such that one side surface of the inorganic conductive film is exposed a long a longitudinal direction of the partition wall; and the electrode is electrically conducted to at least the one side surface of the inorganic conductive film, which is exposed.

According to a third aspect of the present invention, in the second aspect of the present invention, there is provided a manufacturing method of a head chip characterized in that:

the electrode is formed byway of selective electroless plating such that the electrode is made in contact with the exposed one side surface of the inorganic conductive film to thereby be electrically conducted to the inorganic conductive film; and also the metal film is formed on the inorganic conductive film of the outer side of the partition wall along the longitudinal direction, whereby the electrode is electrically and mutually conducted via the inorganic conductive film to the metal film.

According to a fourth aspect of the present invention, in any one of the first to third aspects of the present invention, there is provided a manufacturing method of a head chip, characterized by further comprising, prior to the step of forming the electrode and the metal film:

a step of forming an inorganic conductive film having a predetermined shape, which constitutes a portion of the wiring line, on any one of the first board and the second board; and a step of providing the partition wall on the one board where the inorganic conductive film is formed.

According to a fifth aspect of the present invention, in any one of the first to third aspects of the present invention, there is provided a manufacturing method of a head chip characterized in that:

the step for forming the partition wall includes:

a step of joining a piezoelectric ceramic plate corresponding to a block which constitutes a plurality of partition walls on any one of the first board and the second board; and a step of cutting the piezoelectric ceramic plate to form a plurality of partition walls.

According to a sixth aspect of the present invention, in the fifth aspect of the present invention, there is provided a manufacturing method of a head chip characterized in that:

the piezoelectric ceramic plate is jointed on the one board where the inorganic conductive film is formed, and both the piezoelectric ceramic plate and the one board located up to a portion of the one board in the thickness direction are removed, whereby the plurality of portion walls are formed.

According to a seventh aspect of the present invention, in any one of the first to third aspects of the present invention, there is provided a manufacturing method of a head chip characterized in that:

the dielectric material is glass.

According to a eighth aspect of the present invention, in any one of the first to third aspects of the present invention, there is provided a manufacturing method of a head chip characterized in that:

the inorganic conductive film is made of at least one sort of material selected from the group consisting of ITO, Sn, $O_2$, ZnO, and ATO.

According to a ninth aspect of the present invention, in any one of the first to third aspects of the present invention, there is provided a manufacturing method of a head chip characterized in that:

a thickness of the inorganic conductive film is set to be equal to or thinner than 3 $\mu$m.

According to a tenth aspect of the present invention, in any one of the first to third aspects of the present invention, there is provided a manufacturing method of a head chip characterized in that:

the partition wall is formed by adhering two members, which have different polarization, to each other.

According to a eleventh aspect of the present invention, in any one of the first to third aspects of the present invention, there is provided a manufacturing method of a head chip characterized in that:

both the electrode and the metal film are made of at least one material selected from nickel and gold.

According to a twelfth aspect of the present invention, in any one of the first to third aspects of the present invention, there is provided a manufacturing method of ahead chip, characterized by further comprising a step of providing a nozzle plate on one opening end of the chamber along a longitudinal direction of the partition wall, the nozzle plate having nozzle openings which are communicated to the respective chambers.

According to a thirteenth aspect of the present invention, in the twelfth aspect of the present invention, there is provided a manufacturing method of a head chip characterized in that:

the nozzle plate is made of a dielectric material.

In accordance with the manufacturing method of the present invention, while the board made of the dielectric material is employed, the inorganic conductive film, that has the better fitting characteristic with the dielectric material, is provided at the lowermost layer of the wiring line. As a consequence, the manufacturing step can be made simple, and also the manufacturing cost can be reduced. Moreover, the wiring lines can be easily and firmly conducted to the electrodes.

DETAILED DESCRIPTION OF THE PREFERRED EMBODIMENTS

Hereinafter, the present invention will be described in detail with reference to embodiments.

Figure 1:
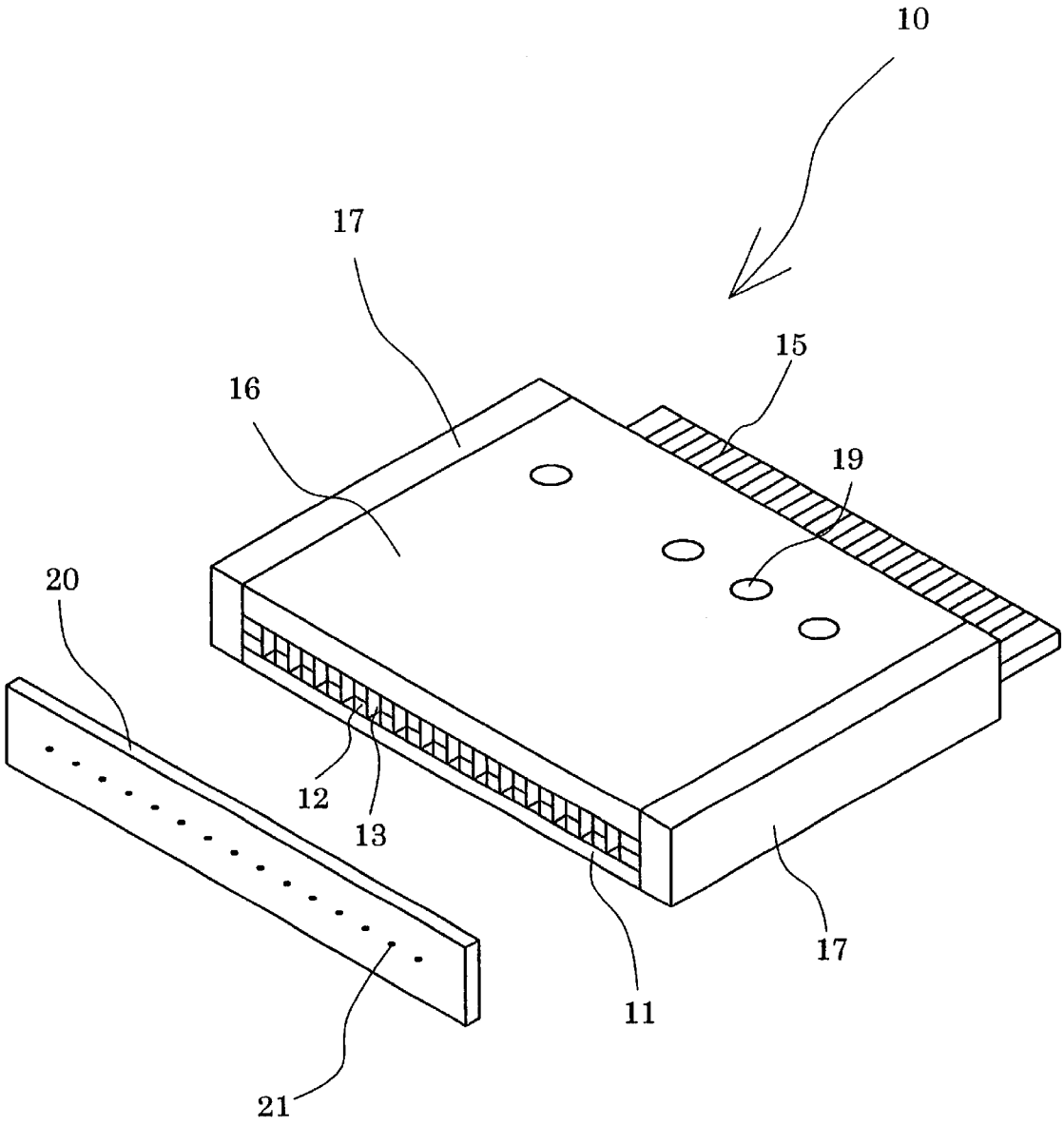
FIG. 1 is a perspective view showing a head chip according to an embodiment of the present invention.
Figure 2:
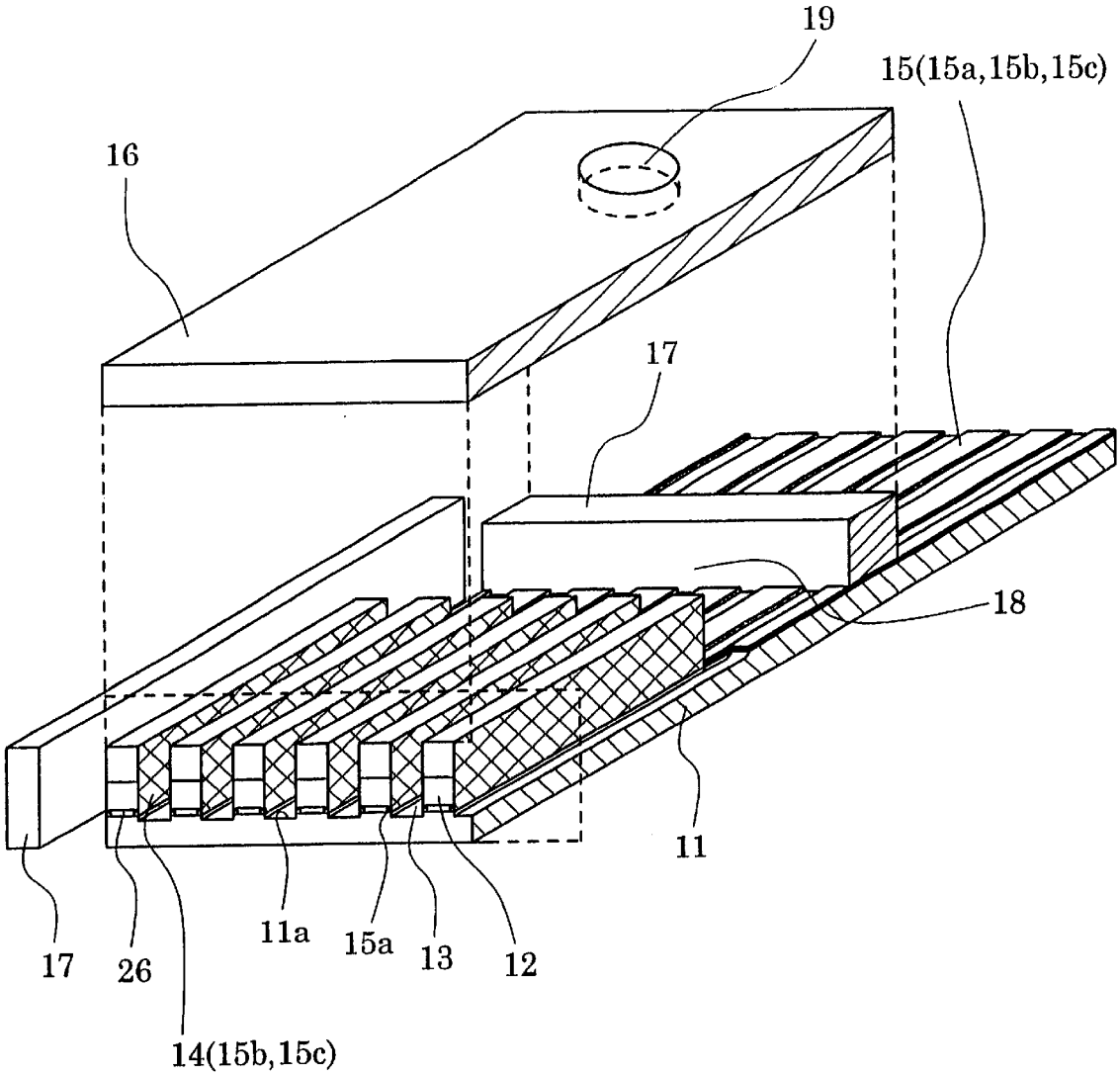
FIG. 2 is a perspective/sectional view indicating the head chip according to the embodiment of the present invention.
Figure 3A:
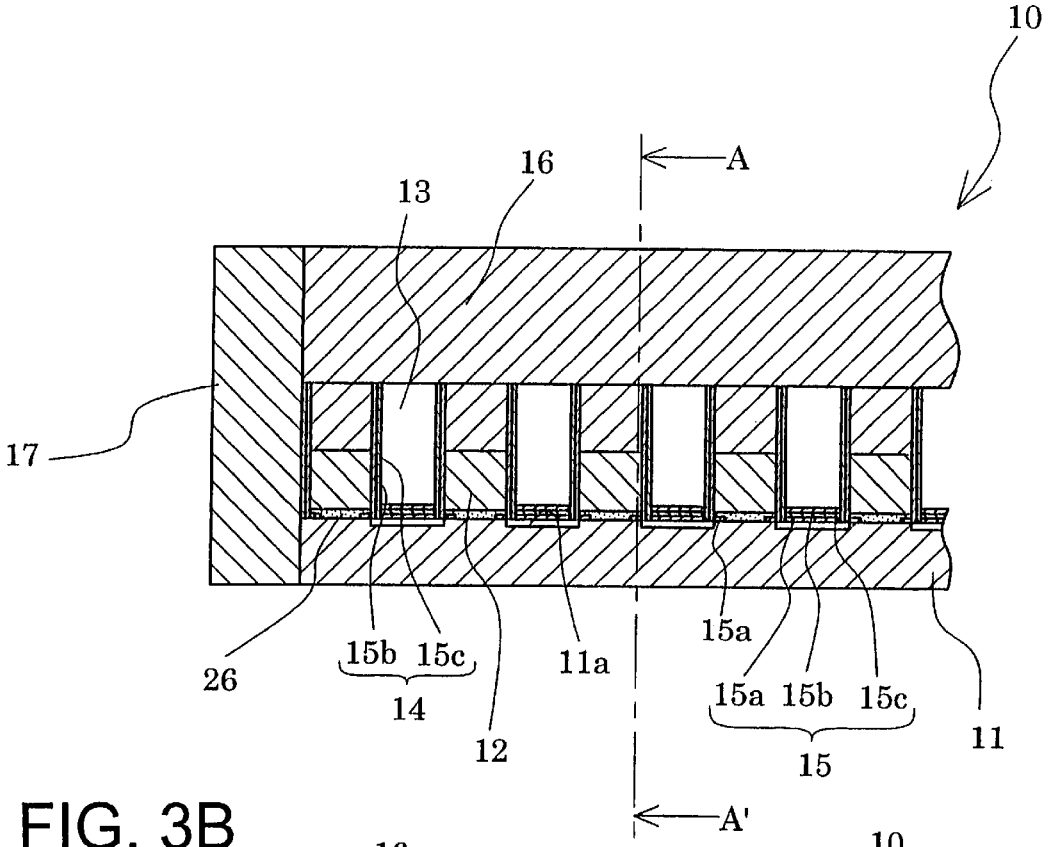
FIGS. 3A and 3B are sectional views representing the head chip according to the embodiment of the present invention, taken along a parallel-arranging direction of this head chip, and also a sectional view of the head chip, taken along a line A–A' thereof.
Figure 3B:
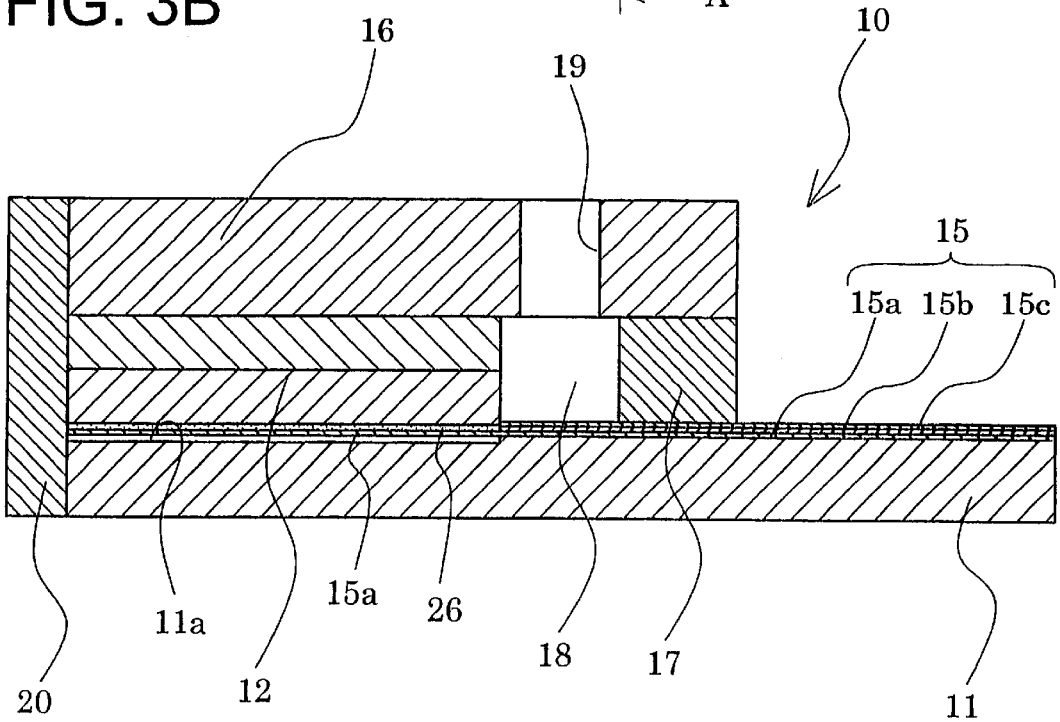

FIG. 1 is a perspective view indicating a head chip according to an embodiment of the present invention. FIG. 2 is a sectional/perspective view of the head chip. FIG. 3A is a sectional view showing a chamber along a parallel-arranging direction, and FIG. 3B is a sectional view of the chamber, taken along a line A–A' of FIG. 3A.

As indicated in the drawings, a plurality of partition walls 12 made of piezoelectric ceramics are arranged in a parallel manner with keeping a predetermined interval on a glass board 11 having a plate shape. A plurality of chambers 13 are defined by the partition walls 12.

An electrode 14 used to apply a driving electric field is formed over an entire surface of each side surface of the partition wall 12 which constitutes an inner surface of each of these chambers 13.

On the glass board 11, wiring lines 15 electrically conducted to the respective electrodes 14 are elongated up to outer sides of the respective partition walls 13 along the longitudinal direction. Further, in a region located opposite to the partition wall 12, the wiring lines 15 are provided in such a region along the longitudinal direction, which is located opposite to each of both edge portions of the partition wall 12 along the width direction. Then, while the side surface of the wiring lines 15 on the side of the chamber 13 are exposed, the wiring lines 15 are firmly made in contact with the electrode 14 on this exposed side surface. Thus, the electrode 14 can be electrically conducted to the wiring lines 15.

This wiring line 15 is constituted of an inorganic conductive film 15*a* provided on the lowermost layer, and at least one layer of a metal film formed on this inorganic conductive film 15*a*. In this embodiment, this metal film is constituted of two layers of metal films 15*b* and 15*c*.

Also, guide walls 17 made of plastic are fixed by an adhesive agent or the like on a position, that is located opposite to one end of each of the partition walls 12 in the longitudinal direction on the glass board 11, and both side surfaces of the glass board 11. An ink chamber 18 which is communicated to each of the chambers 13 is defined by both the guide wall 17 and the partition wall 12 on the glass board 11. This ink chamber 18 is sealed by a cover plate 16 made of a plate-shaped glass material, which is joined on the side opposite to the glass board 11 of the partition wall 12. It should be noted that an ink supply port 19 used to supply ink to the ink chamber 18 is formed in this cover plate 16 by using, for example, sandblasting.

Also, a nozzle plate 20 is jointed to an edge surface which is identical to an edge surface of the glass board 11 of the partition wall 12. A nozzle opening 21 is pierced in a position which is located opposite to each of the chambers 13 of this nozzle plate 20. This nozzle plate 20 may be manufactured by plastic, glass, or a polyimide film.

Now, a manufacturing step for such a head chip according to this embodiment will be described in detail. FIG. 4 and FIG. 6 are top views representing the manufacturing steps of the head chip, and FIG. 5 and FIG. 7 are sectional views showing the head chips at the respective manufacturing steps along the parallel-arranging direction of the chambers 13.

Figure 4A:
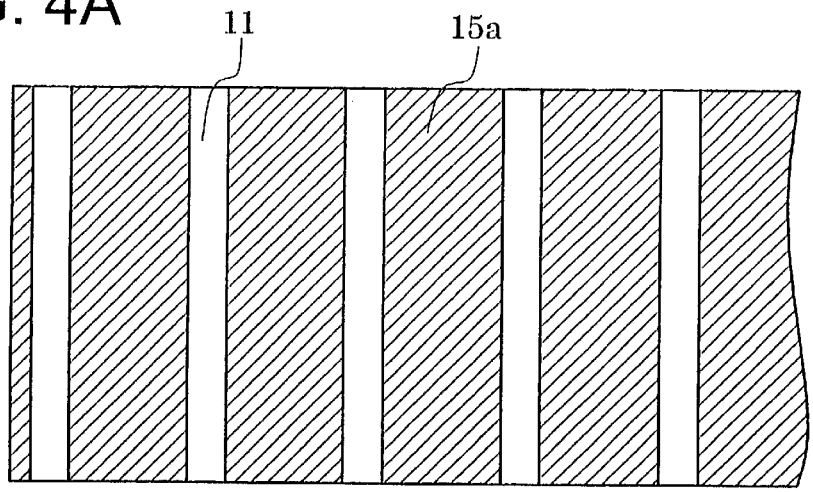
FIGS. 4A, 4B and 4C are top views showing a manufacturing method of the head chip according to the embodiment of the present invention.
Figure 5A:
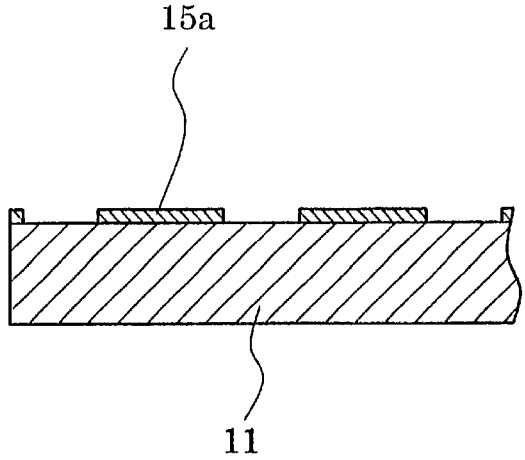
FIGS. 5A, 5B and 5C are sectional views representing the head chip corresponding to the respective manufacturing steps of FIG. 5 along the parallel-arranging direction of the chamber.

As shown in FIG. 4A and FIG. 5A, the inorganic conductive film 15*a* having a predetermined shape is formed on the plate-shaped glass board 11. Concretely speaking, after the inorganic conductive film 15*a* has been formed on the entire surface of the glass board 11, this formed inorganic conductive film 15*a* is patterned. Thus, the respective inorganic conductive films 15*a* are formed on such a region where the respective chambers 13 are formed on the glass board 11. The width of each of the inorganic conductive films 15*a* is made slightly wider than the width of each of the chambers 13.

In this case, as a material of the inorganic conductive film 15*a*, for instance, ITO (oxide made of indium and tin), $SnO_2$, ZnO or ATO (oxide made of antimony and tin) may be employed. In this embodiment, ITO is used.

If the film thickness of such an inorganic conductive film 15*a* is made excessively thick, the following fears may occur that when the partition wall 12 is adhered to the inorganic conductive film 15*a* at the below-mentioned step, insufficient adhesion readily occurs, and that when the partition wall 12 is driven, this partition wall 12 is moved and/or stripped. As a consequence, it is preferable that the film thickness of the inorganic conductive film 15*a* is made relatively thin, preferably made equal to or thinner than 3 $\mu$m.

It should also be noted that the method of forming this inorganic conductive film 15*a* is not specifically limited. For instance, after the inorganic conductive film 15*a* has been manufactured by a sputtering method, a coating method or the like, the manufactured inorganic conductive film may be patterned by employing a photolithographic method or the like.

Figure 4B:
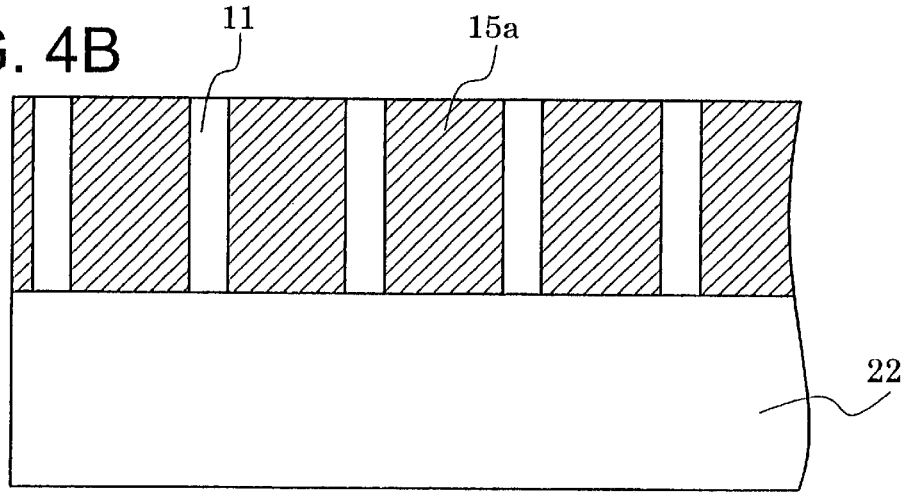
Figure 5B:
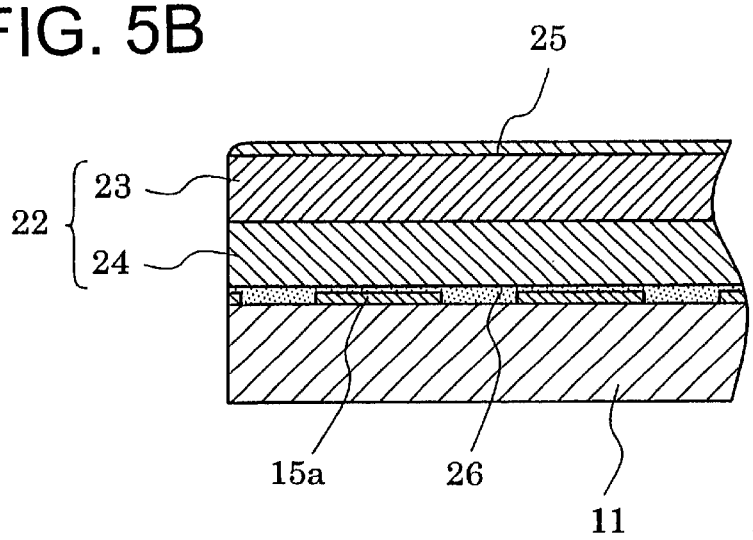

Subsequently, as shown in FIG. 4B and FIG. 5B, a piezoelectric ceramic plate 22 is adhered on the inorganic conductive film 15*a* by using an adhesive agent 26 such that this piezoelectric ceramic plate 22 is aligned to one edge of the glass board 11.

It should also be noted that this piezoelectric ceramic plate 22 is formed such that two sheets of piezoelectric ceramic plates 23 and 24, the polarization directions of which are different from each other, are adhered to each other along the thickness direction in this embodiment. Also, surfaces other than the adhesive surface of this piezoelectric ceramic plate 22 are coated in advance by using resist 25 before being adhered. This is a process to remove an unnecessary electrode film in the below-mentioned manufacturing step. Alternatively, this resist 25 may be apparently formed after the adhesive process.

Figure 4C:
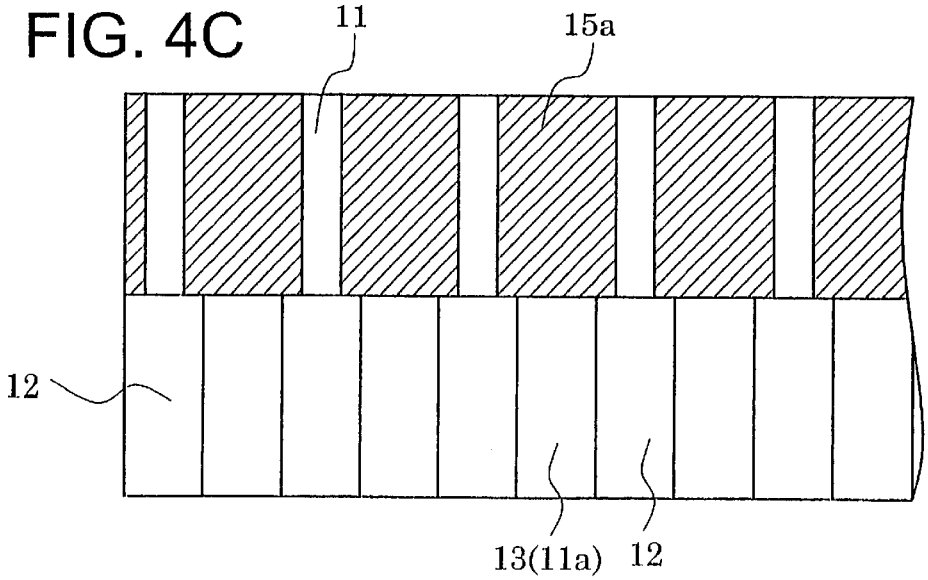
Figure 5C:
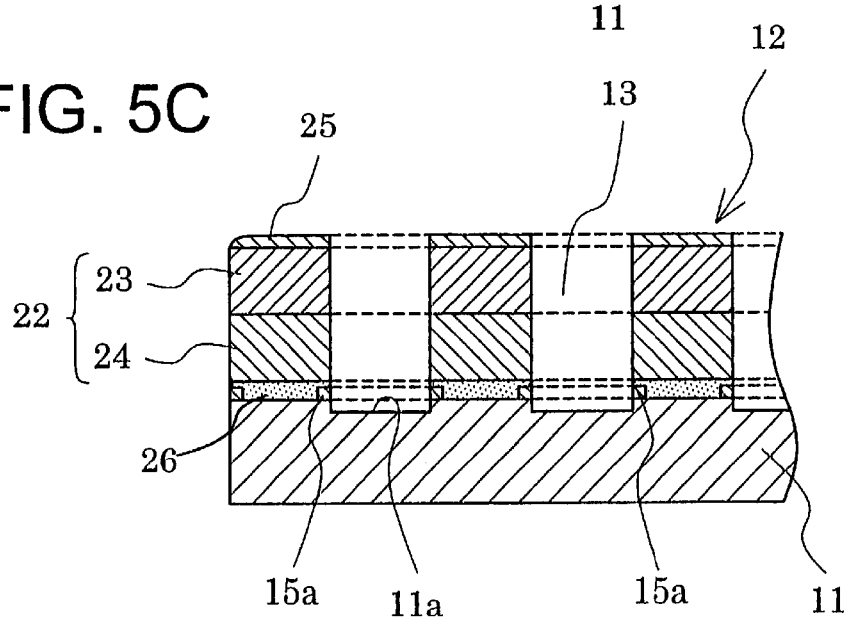

Subsequently, as shown in FIG. 4C and FIG. 5C, the piezoelectric ceramic plate 22 is cut into the respective partition walls 12, and also the chamber 13 is formed. In other words, the piezoelectric ceramic plate 22 is cut along the thickness direction so as to form the partition walls 12 such that grooves having predetermined widths, which will form the chambers 13, are formed in this piezoelectric ceramic plate 22 by using, for example, a disk-shape die cutter.

At this time, the inorganic conductive film 15*a* has to be cut in connection with the piezoelectric ceramic plate 22 in order that the inorganic conductive film 15*a* formed on the glass board 11 does not become conductive within the chamber 13. Therefore, in this embodiment, the inorganic conductive film 15*a* is firmly cut by removing a part of the glass board 11 in the thickness direction to form a concave portion 11*a*. Apparently, while the inorganic conductive film 15*a* is previously patterned, this inorganic conductive film 15*a* may be brought in to the cut-out condition. Also, if the inorganic conductive film 15*a* is completely cut, the concave portion 11*a* may not be formed.

As previously explained, since the inorganic conductive film 15*a* is patterned with the width that is made slightly wider than the width of the chamber 13, when the partition wall 12 is formed, and also when the piezoelectric ceramic plate 22 is cut, the inorganic conductive film 15*a* will be left along the longitudinal direction between both the edge portions of the partition wall 12 in the width direction and the glass board 11, and the side surface of this remaining inorganic conductive film 15*a* is exposed.

It should be noted that this inorganic conductive film 15*a* is continued up to the outer side of the partition wall 12.

Figure 6A:
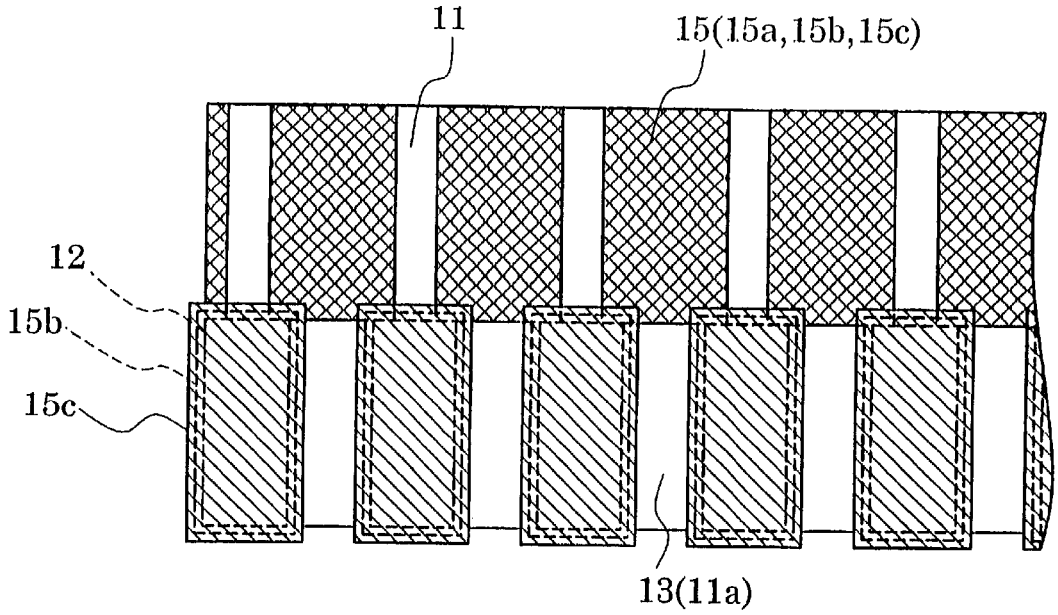
FIGS. 6A and 6B are top views showing a manufacturing method of the head chip according to the embodiment of the present invention.
Figure 7A:
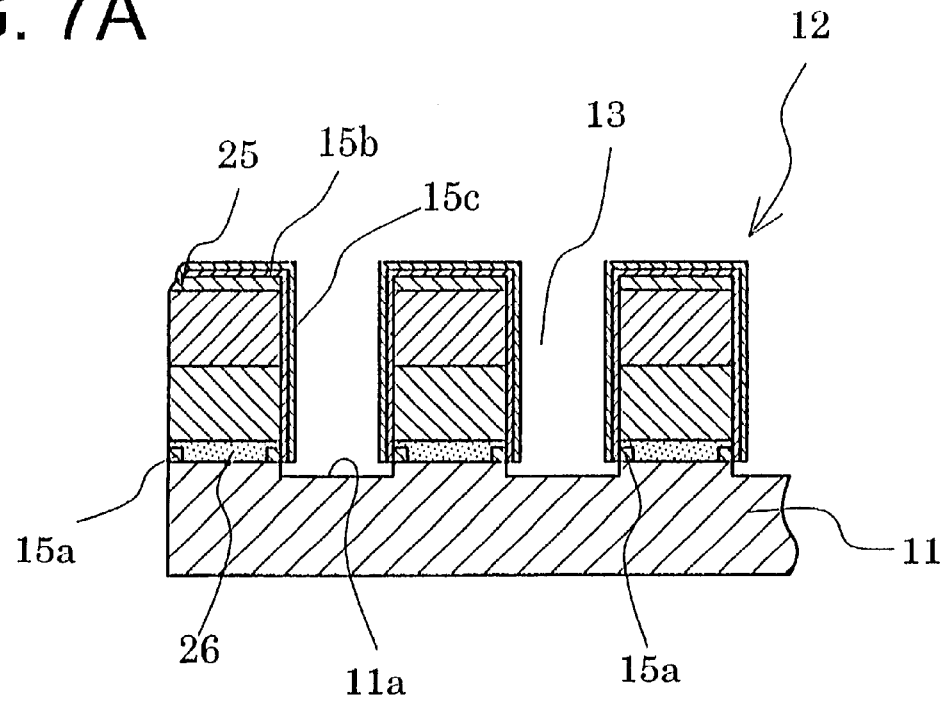
FIGS. 7A and 7B are sectional views representing the head chip corresponding to the respective manufacturing steps of FIG. 7 along the parallel-arranging direction of the chamber.

Subsequently, as shown in FIG. 6A and FIG. 7A, a starting catalyst containing palladium, platinum or the like is absorbed over the entire surfaces of both the partition wall 12 and, the inorganic conductive film 15*a*, namely surfaces other than the surface of the glass board 11. Thereafter, the electrode 14 and both the metal film 15*b* made of nickel and the metal film 15*c* made of gold, which may constitute a portion of the wiring line 15, are successively formed by way of the selective electroless plating.

Such a wiring line 15, that is made of three layers, namely the inorganic conductive film 15*a*, the nickel metal film 15*b*, and the gold metal film 15*c*, is formed outside the partition wall 12 by this selective electroless plating. Also, both the metal films 15*b* and 15*c* formed over the entire surface of the partition wall 12 may be electrically conducted to the inorganic conductive film 15*a* formed between the partition wall 12 and the glass board 11 on the exposed side surfaces thereof.

Figure 6B:
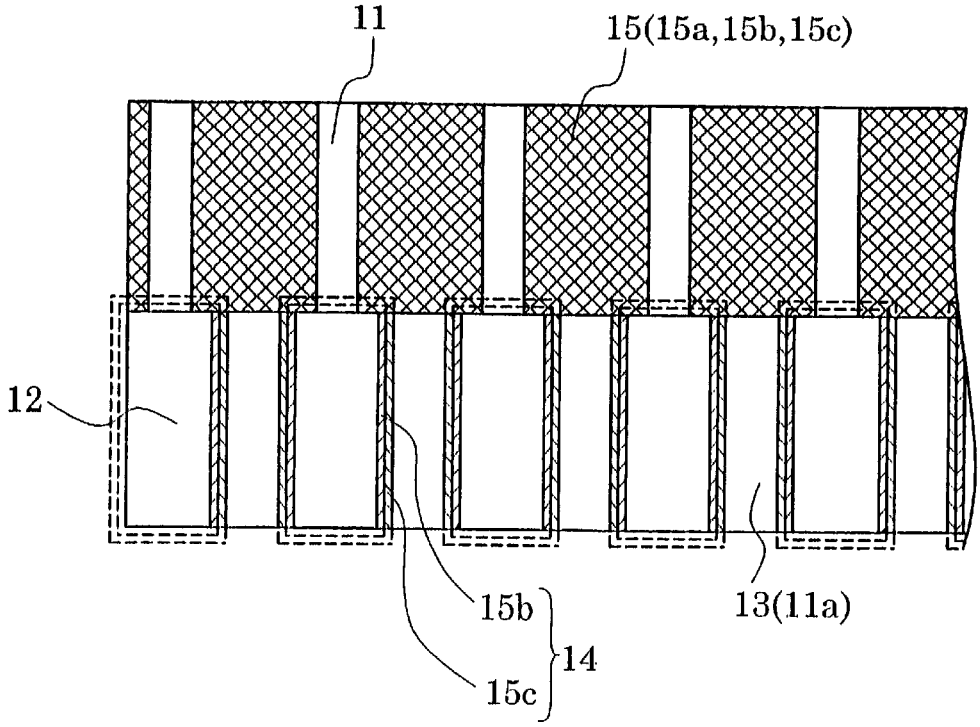
Figure 7B:
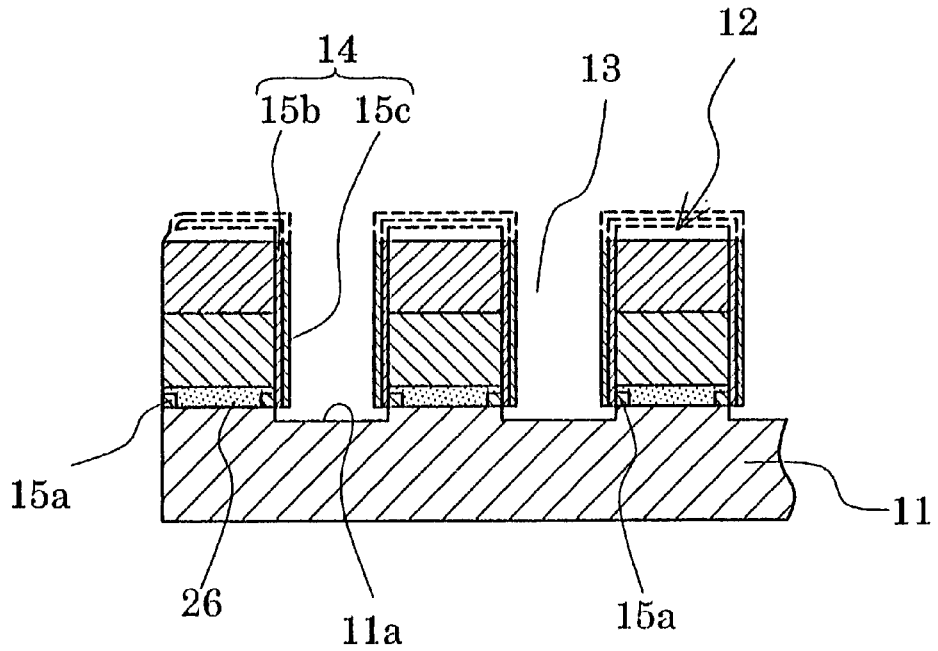

Next, as shown in FIG. 6B and FIG. 7B, the resist 25, which is formed on both the upper surface of the partition wall 12 and the edge surfaces of the partition wall 12 along the longitudinal direction, and also unnecessary metal films 15*b* and 15*c* formed on the resist 25 are lifted off. As a result, such an electrode 14, which is not short-circuited on both the side surfaces of the partition wall 12 and which is constructed of two layers made from the nickel metal film 15*b* and the gold metal film 15*c*, is formed.

As previously explained, both the electrode films 15*b* and 15*c* which constitute the electrode 14 formed in this manner are electrically conducted with the inorganic conductive film 15*a* on the exposed side surfaces thereof. In other words, the electrode 14 is mutually and electrically conducted via the inorganic conductive film 15*a* to the wiring line 15.

Thereafter, as indicated in FIG. 1 to FIG. 3, the guide wall 17 made of plastic is fixed on the rear portion of each of the partition walls 12, and also both the edge surfaces of the glass board 11 along the parallel-arranging direction of the partition walls 12 by using the adhesive agent or the like, so that the ink chamber 18 is defined on the glass board 11. Then, the cover plate 16 is fixed by using the adhesive agent or the like on the side opposite to the glass board 11 of the partition wall 12, and also the nozzle plate 20 having a plate shape, in which the nozzle openings 21 are pierced, is fixed on the side edge surface of the partition wall 12 of the glass board 11 with respect to each of the chambers 13. Then, the outer shape of the resultant head chip is processed by using the die, and thus, a desirable head chip 10 may be manufactured.

As explained above, in the manufacturing method in accordance with this embodiment, the inorganic conductive film 15*a* is patterned on the glass board 11, and the selective electroless plating is performed on, this inorganic conductive film 15*a*. As a result, the wiring lines 15 can be readily manufactured, and also the head chip can be manufactured while improving the fitting characteristic between the glass board 11 and the wiring lines 15.

Also, since the electrode 14 can be formed at the same time when the wiring lines 15 are formed, the entire manufacturing steps can be made simpler, and further, the manufacturing cost can be reduced. Furthermore, the manufacturing cost can be reduced by using a large amount of low-cost glass.

Figure 8:
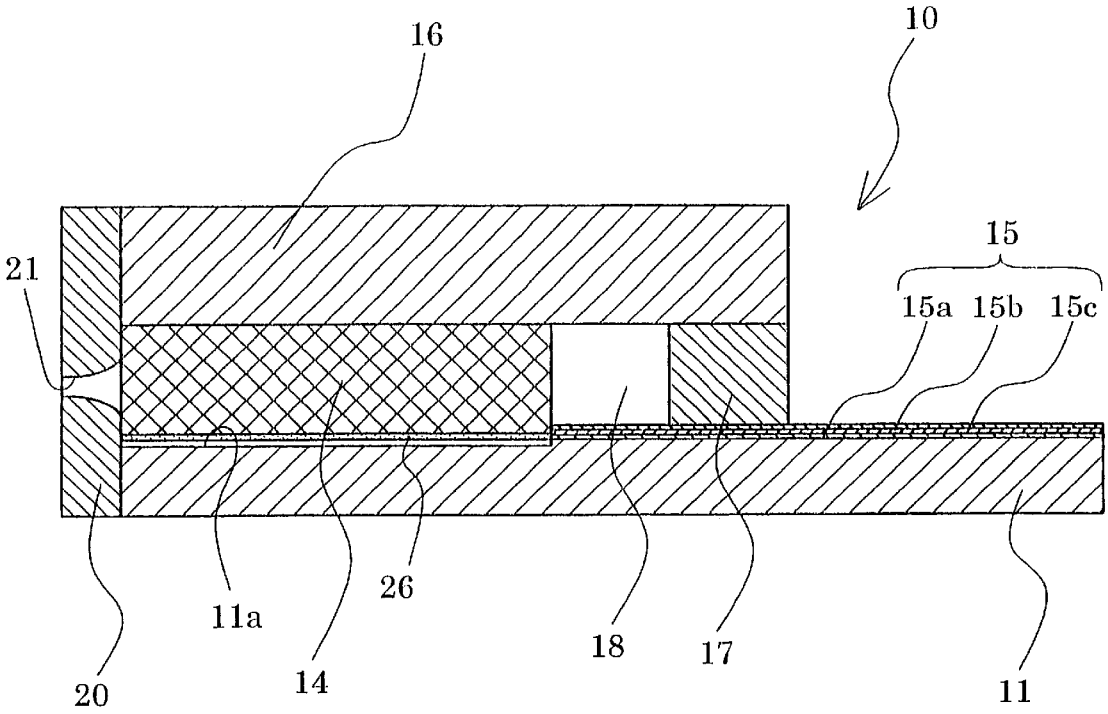
FIG. 8 is a sectional view showing another example of an inorganic conductive film according to the present invention, along a longitudinal direction of the chamber.

It should be noted that in this embodiment, the inorganic conductive film 15*a* elongated between the glass board 11 and the partition wall 12 is formed along the longitudinal direction of the partition wall 12. The present invention is not limited thereto if the inorganic conductive film 15*a* can be electrically conducted to the electrode 14 provided on the side surface of the partition wall 12. Only a portion of the inorganic conductive film 15*a* may be elongated along the longitudinal direction. For instance, as indicated in FIG. 8, the inorganic conductive film 15*a* is not elongated between the glass board 11 and the partition wall 12, but may be alternatively provided so as to be in contact with the edge surface of the partition wall 12. In any cases, it is necessary that the electrode 14 is surely and electrically conducted with the wiring lines 15. It should be noted that FIG. 8 is a sectional view showing the chamber 13 along the longitudinal direction, in which both the metal films 15*b* and 15*c* which constitute a portion of the wiring lines 15, are continued to the electrode 14 at the edge portions along the longitudinal direction thereof.

Although there is no limitation on the way how to form wiring lines used to drive the head chip 10 manufactured in this manner, one example thereof will now be explained.

Figure 9:
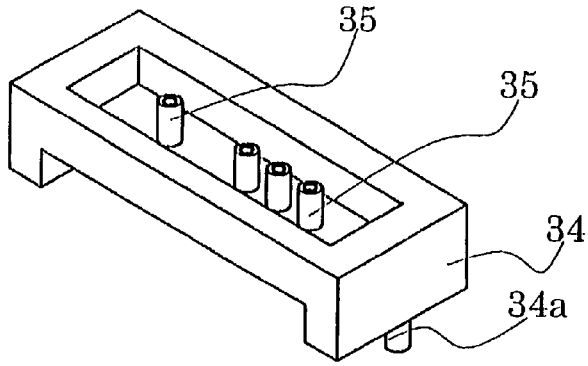
FIG. 9 is a perspective view indicating an assembly of a unit with employment of the head chip according to one embodiment of the present invention.
Figure 9:
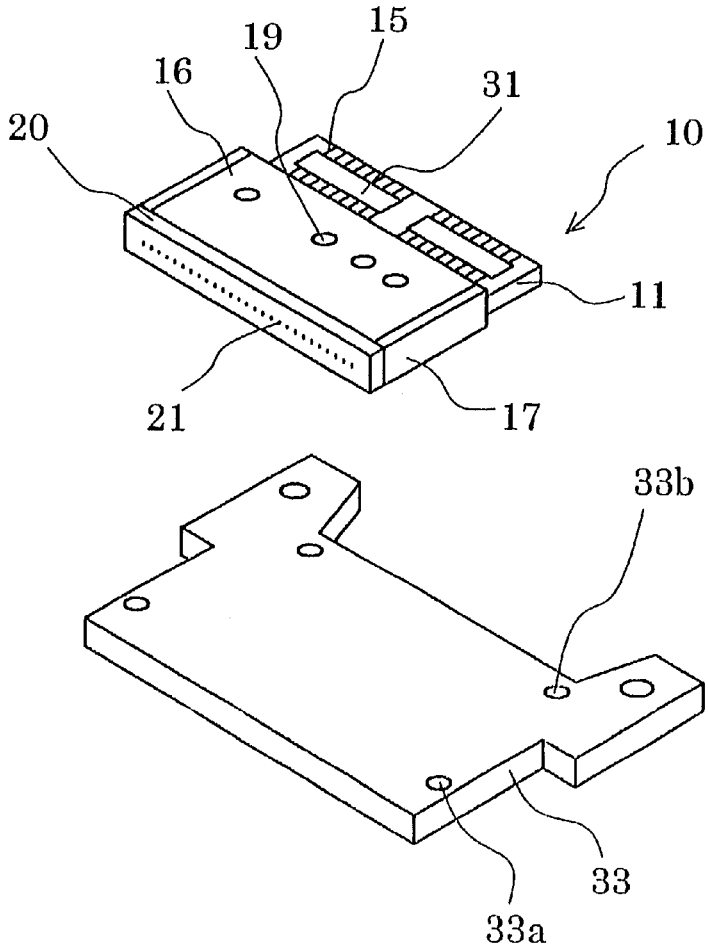

FIG. 9 is an exploded perspective view indicating a head chip unit on which the above-explained head chip 10 is mounted.

As illustrated in FIG. 9, a driver circuit 31 such as an integrated circuit for driving the head chip 10 is directly connected to the wiring line 15, and this driver circuit 31 is mounted on the glass board 11 of the head chip 10. Also, a base plate 33 made of aluminum is assembled on the side of the glass board 11, and a head cover 34 is assembled on the side of the cover plate 16 in the head chip 10. The base plate 33 is fixed to the head cover 34 such that an engaging shaft 34*a* of the head cover 34 is engaged with an engaging hole 33*a* of the base plate 33, and the head chip 10 is sandwiched by both the base plate 33 and the head cover 34. An ink conducting path 35 is formed on the head cover 34, and this ink conducting path 35 is communicated with each of the ink supply ports 19 of the cover plate 16.

Also, such ahead chip unit 40 may be assembled with, for example, a tank holder, which detachably holds the ink cartridge, to be used.

Figure 10A:
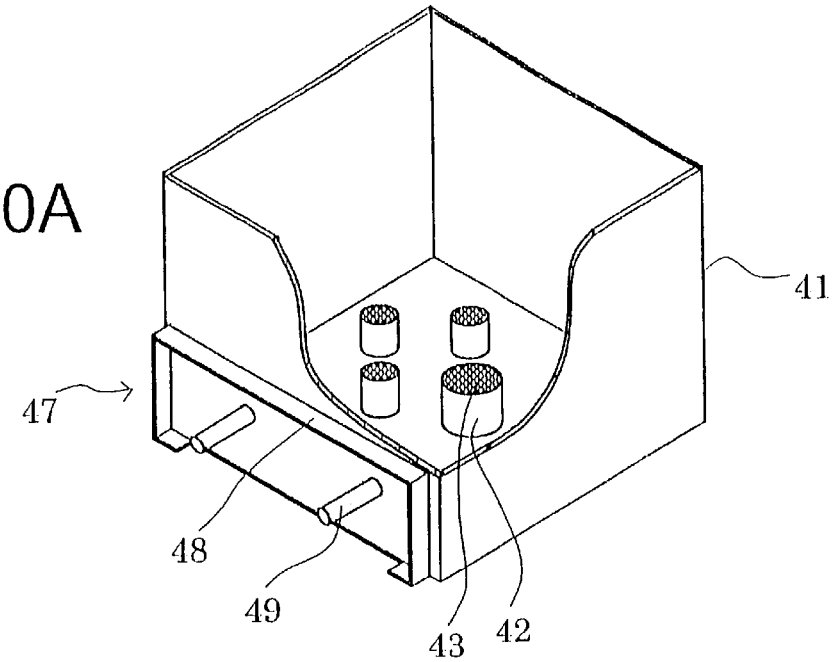
FIGS. 10A and 10B are perspective views indicating an assembly of a unit with employment of the head chip according to one embodiment of the present invention.
Figure 10B:
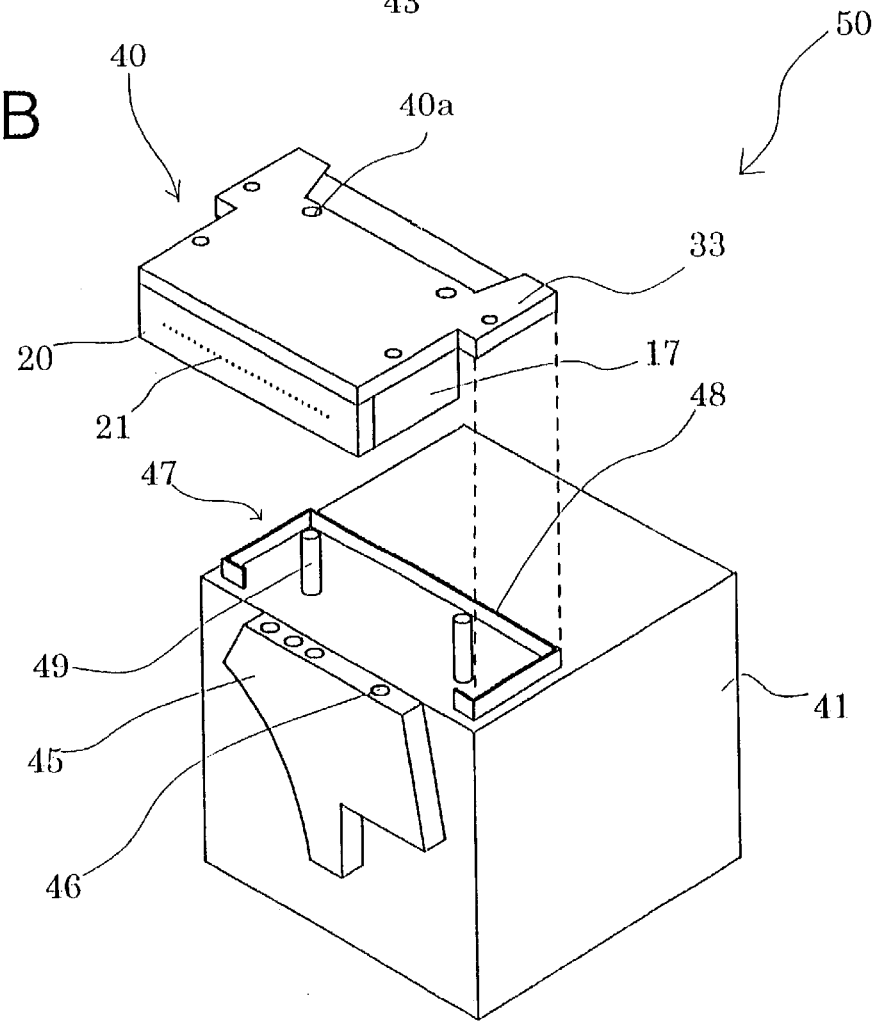

FIG. 10A shows an example of such a tank holder. FIG. 10B shows the tank holder 41 and the head chip unit 40 which is assembled with the tank holder 41. The tank holder 41 shown in FIG. 10 is formed to have substantially a box shape whose one surface is opened, and an ink cartridge (not shown) may be detachably held. A coupling portion 42 is provided on an upper surface of a bottom wall, and is coupled to the ink supply port 19 corresponding to an opening portion formed in the bottom portion of the ink cartridge. A plurality of the coupling portions 42 are provided with respect to each of color ink, for instance, black (B) ink, yellow (Y) ink, magenta (M) ink, and cyan (C) ink. An ink flow path (not shown) is formed inside the coupling portion 42, and a filter 43 is provided at a tip portion of the coupling portion 42 which constitutes an opening of this ink flow path. The ink flow path formed inside the coupling portion 42 is communicated to the rear surface of the bottom wall. The respective ink flow paths are communicated to a head coupling port 46 which is opened in the partition wall of a flow path board 45 via an ink flow path (not shown) which is provided within the flow path board 45 provided on the side of the rear surface of the tank holder 41. This head coupling port 46 is opened on the side of the side surface of the tank holder 41, and a head chip unit holding portion 47 which holds the above-described head chip unit 40 is provided on the bottom portion of this partition wall. In the head chip unit holding portion 47, there are provided a surrounding wall 48 and an engaging shaft 49. The surrounding wall 48 surrounds the driver circuit 31 provided on the glass board 11, and is formed into substantially a U-shape and positioned in an upright manner. The engaging shaft 49 is engaged with an engaging hole 33*b* formed in the base plate 33 of the head chip unit 40 provided inside the surrounding wall 48.

As a consequence, the head chip unit 40 is mounted on this head chip unit holding portion 47, so that a head unit 50 can be completed. At this time, the ink conducting path 35 formed in the head cover 34 is coupled to the head coupling port 46 of the flow path board 45. As a result, the ink which is conducted from the ink cartridge via the coupling portion 42 of the tank holder 41 is conducted via the ink flow path formed in the flow path board 45 into the ink conducting path 35 of the head chip unit 40, so that this ink is filled into both the ink chamber 18 and the chamber 13.

Figure 11:
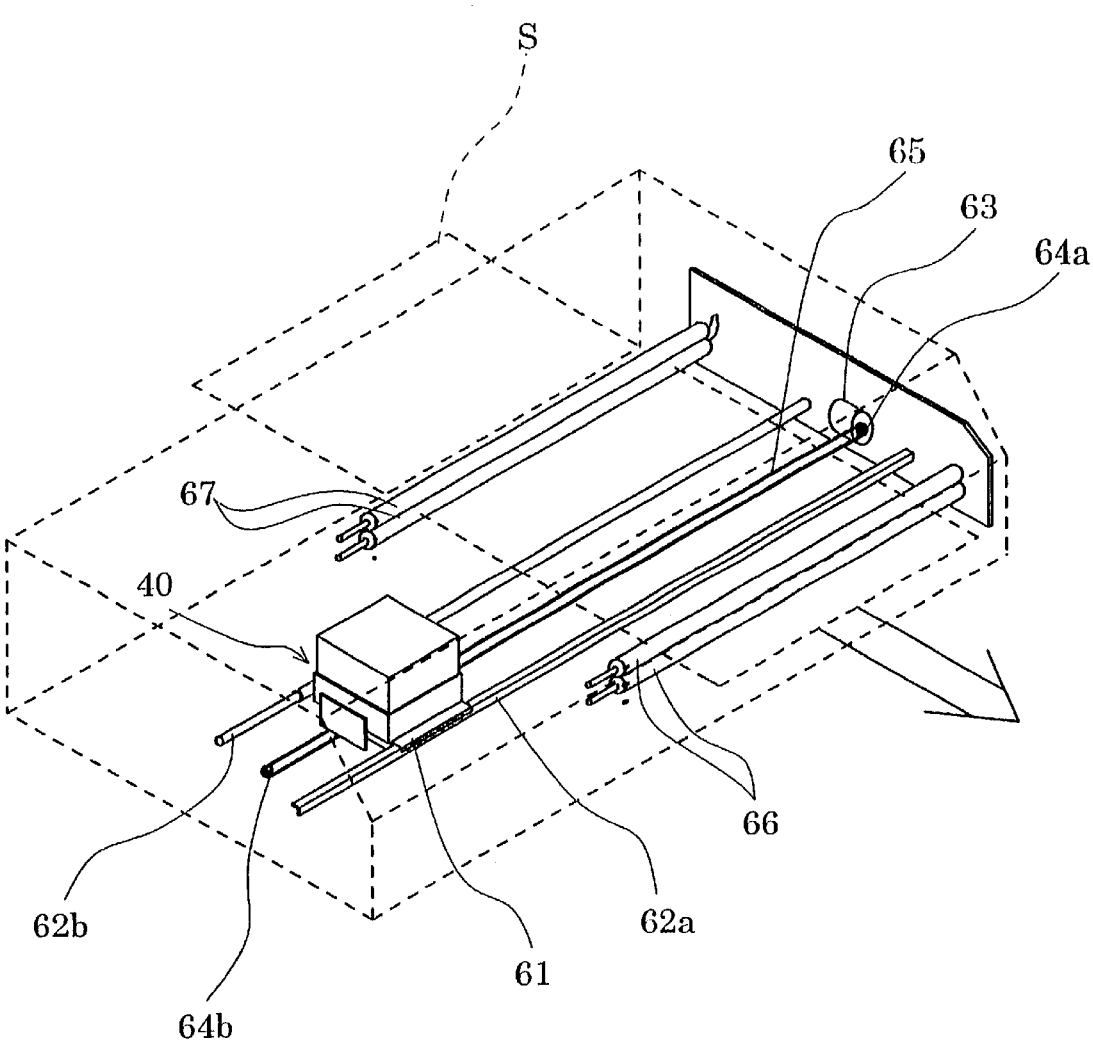
FIG. 11 is a perspective view showing a use mode of the unit with employment of the head chip according to one embodiment of the present invention.
Figure 12:
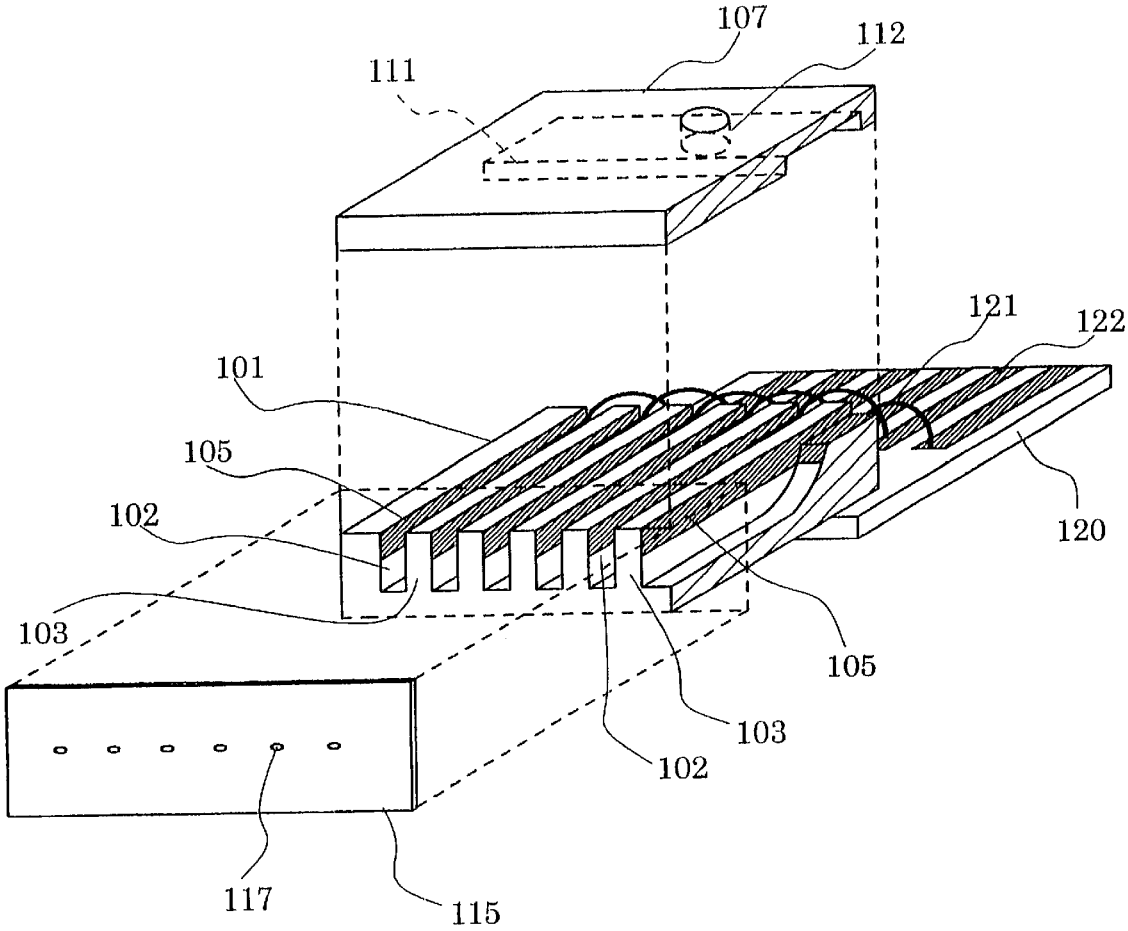
FIG. 12 is an exploded/perspective view schematically indicating a recording head in accordance with a conventional technique.
Figure 13A:
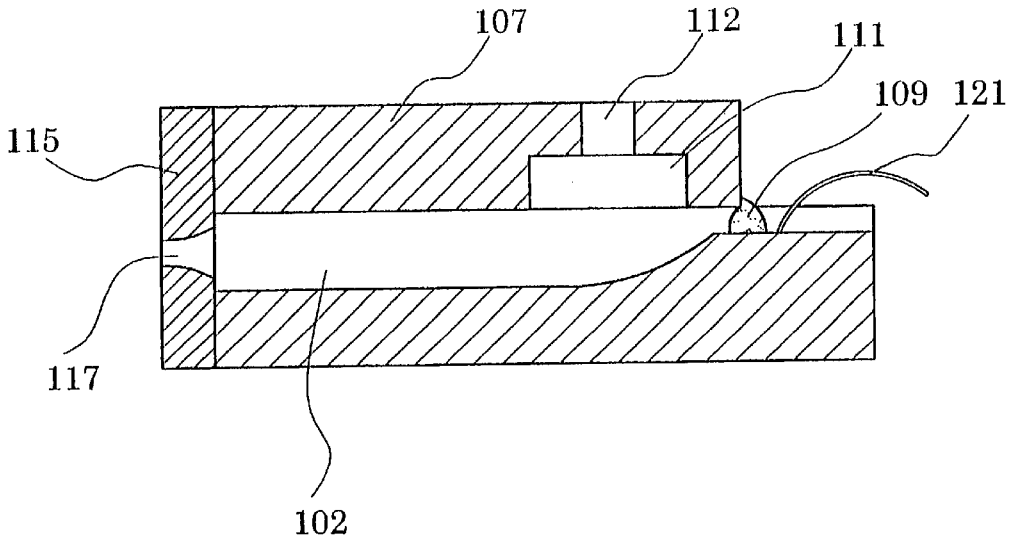
FIG. 13A PRIOR ART
FIGS. 13A and 13B are sectional views schematically indicating the recording head in accordance with the conventional technique.
Figure 13B:
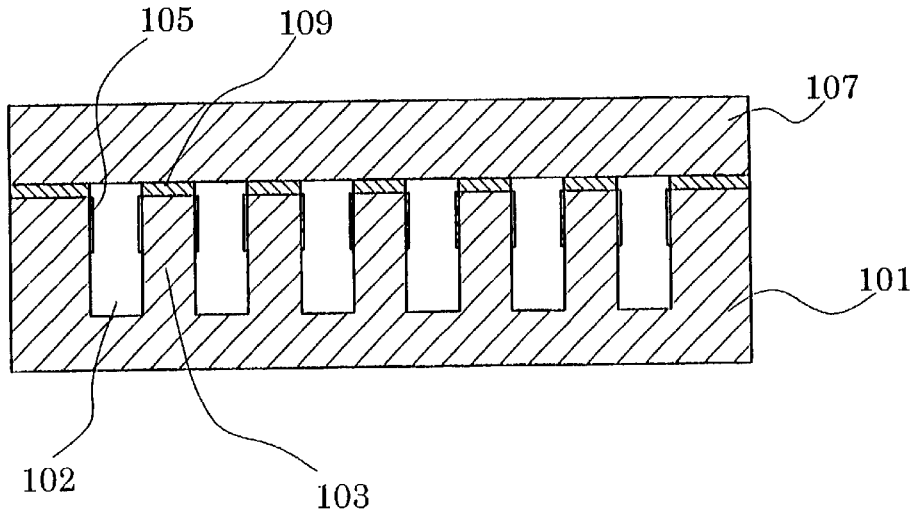
FIG. 13B PRIOR ART
Figure 14:
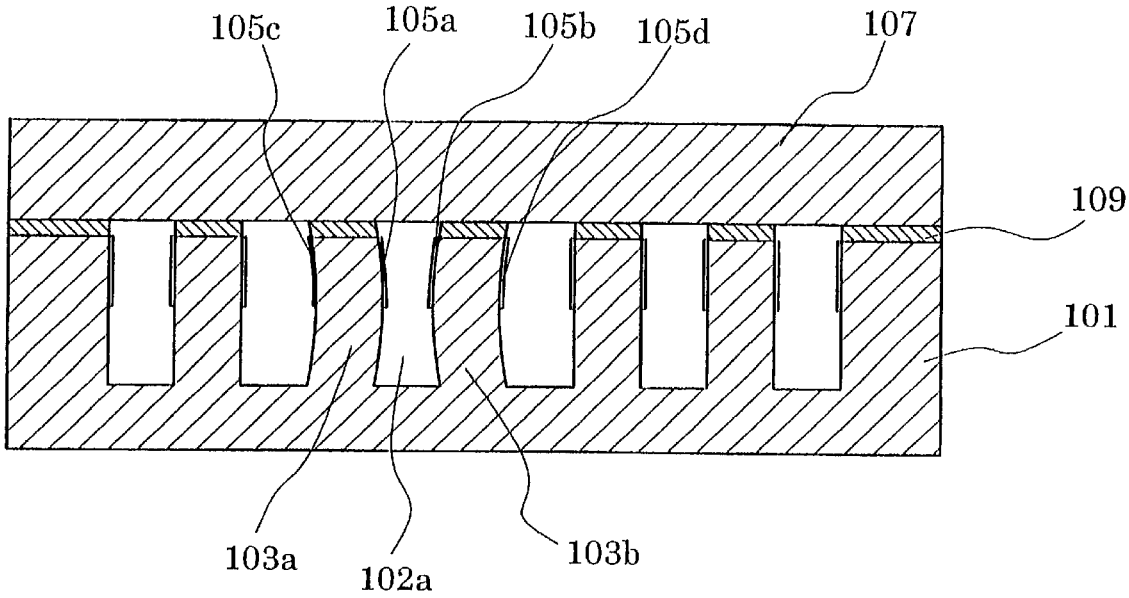
FIG. 14 is a sectional view schematically indicating the recording head in accordance with the conventional technique.

Such a head unit 50 is mounted on, for instance, a carriage of an ink-jet type recording apparatus so as to be used. FIG. 11 schematically shows an example of this use mode of the head unit 50.

As shown in FIG. 11, a carriage 61 is movably mounted on one pair of guiderails 62*a* and 62*b* along an shaft direction. This carriage 61 is transported by way of a timing belt 65 which is suspended between a pulley 64*a*, that is provided on one end side of the guide rail 62, and is coupled to a carriage driving motor 63, and another pulley 64*b* that is provided on the other side of this guide rail 62. A pair of transfer rollers 66 and 67 are provided along the guide rails 62*a* and 62*b* on both sides in a direction perpendicular to the transport direction of the carriage 61. These transfer rollers 66 and 67 are used to transport a recording medium "S" located below the carriage 61 along a direction perpendicular to the transport direction of this carriage 61.

The above-explained head unit 50 is mounted on the carriage 61, and the above-explained ink cartridge may be detachably mounted on this head unit 50.

In accordance with such an ink-jet type recording apparatus, while the recording medium "S" is fed, the carriage 61 is scanned along the direction perpendicular to this medium feeding direction, so that both a character and an image can be recorded on this recording medium "S" by the head chip.

While the present invention has been described in connection with the foregoing embodiment, the present invention is not limited to such a construction thereof.

As previously described, in accordance with the present invention, both the upper board and the lower board, which sandwich the partition wall made of the piezoelectric ceramic, are formed by the dielectric material, and also, the inorganic conductive film is employed as the lowermost layer of the wiring lines which are electrically conducted to the electrode. Thus, the manufacturing steps of the wiring lines can be made simple and also can be manufactured in low cost. Also, the fitting characteristic between the wiring lines and the boards can be improved.

What is claimed is:

1. A method of manufacturing a head chip, comprising the steps of:

disposing a plurality of partition walls made of piezoelectric ceramic between a pair of opposing substrates made of a dielectric material so that the partition walls are spaced apart at a preselected interval to form a plurality of channels;

forming a plurality of inorganic conductive films on a surface of one of the substrates;

forming at least one metal film on a portion of each of the inorganic conductive films;

forming an electrode on a side surface of each of the channels; and electrically connecting each of the electrodes to a respective one of the metal films via a respective one of the inorganic conductive films.

2. A method according to claim 1; wherein the disposing step includes disposing the partition walls on the surface of the substrate on which the inorganic conductive films are formed.

3. A method according to claim 1; further comprising the step of forming the partition walls before the disposing step by connecting a piezoelectric ceramic plate to one of the opposing substrates and cutting the piezoelectric ceramic plate to form the partition walls.

4. A method according to claim 3; wherein the connecting step comprises connecting the piezoelectric ceramic plate to the substrate on which the inorganic conductive films are formed; and wherein the cutting step comprises removing preselected portions of the piezoelectric ceramic plate and the substrate to which the piezoelectric ceramic plate is connected to form the partition walls.

5. A method according to claim 1; wherein the dielectric material comprises glass.

6. A method according to claim 1; wherein each of the inorganic conductive films is made of at least one material selected from the group consisting of ITO, $SnO_2$, ZnO, and ATO.

7. A method according to claim 1; wherein a thickness of each of the inorganic conductive films is equal to or less than 3 $\mu$m.

8. A method according to claim 1; further comprising the step of forming each of the partition walls before the disposing step by adhering together two members each having a different polarization from the other.

9. A method according to claim 1; wherein each of the electrodes and each of the metal films are made of at least one material selected from the group consisting of nickel and gold.

10. A method according to claim 1; further comprising the steps of providing a nozzle plate having a plurality of nozzle openings extending through opposite main surfaces thereof, and connecting the nozzle plate to the substrates so that each of the nozzle openings is disposed in communication with respective ones of the channels.

11. A method according to claim 10; wherein the nozzle plate is made of a dielectric material.

12. A method according to claim 1; wherein the step of forming the inorganic conductive films comprises forming the inorganic conductive films so that a portion of each of the inorganic conductive films projects outwardly from an edge portion of a respective one of the partition walls in a longitudinal direction thereof.

13. A method according to claim 12; wherein the step of forming the at least one metal film comprises forming the least one metal film on the portion of each of the inorganic conductive films projecting outwardly from the edge portion of the respective one of the partition walls.

14. A method according to claim 1; wherein each of the electrodes and each of the metal films are formed by selective electroless plating.

15. A method of manufacturing a head chip, comprising the steps of:

disposing a piezoelectric ceramic plate on a main surface of a first substrate;

removing preselected portions of the piezoelectric ceramic plate and the first substrate to form a plurality of partition walls spaced apart at a preselected interval to form a plurality of channels;

forming an electrode on a side surface of each of the channels;

forming a plurality of inorganic conductive films on the main surface of the first substrate;

forming at least one metal film on a portion of each of the inorganic conductive films;

electrically connecting each of the electrodes to a respective one of the metal films via a respective one of the inorganic conductive films; and disposing a second substrate in opposite relation to the first substrate so that the partition walls are disposed between the first and second substrates.

16. A method according to claim 15, wherein each of the first and second substrates is made of a dielectric material.

17. A method according to claim 16; wherein the dielectric material comprises glass.

18. A method according to claim 15; wherein the inorganic conductive film comprises a material selected from the group consisting of ITO, $SnO_2$, ZnO, and ATO.

19. A method according to claim 15, wherein each of the inorganic conductive films has a thickness equal to or less than 3 $\mu$m.

20. A method according to claim 15; wherein each of the partition walls comprises two members each having a polarization different from the other.

21. A method according to claim 15; wherein each of the electrodes and each of the metal films are made of at least one material selected from the group consisting of nickel and gold.

22. A method according to claim 15; further comprising the steps of providing a nozzle plate having a plurality of nozzle openings extending through opposite main surfaces thereof, and connecting the nozzle plate to the first and second substrates so that each of the nozzle openings is disposed in communication with respective ones of the channels.

23. A method according to claim 15; wherein the nozzle plate is made of a dielectric material.

24. A method according to claim 14; wherein each of the electrodes and each of the metal films are formed by selective electroless plating.

* * * * *